United States Patent [19]

Cowlin et al.

[11] Patent Number: 5,020,675

[45] Date of Patent: Jun. 4, 1991

[54] APPARATUS FOR SORTING CONVEYED ARTICLES

[75] Inventors: Simon Cowlin, Kelsale; Leslie Clark; Timothy Dennis, both of Colchester; Charith Gunawardena, Colchester, all of United Kingdom

[73] Assignee: Lockwood Graders (UK) Limited, Danbury, England

[21] Appl. No.: 365,713

[22] Filed: Jun. 14, 1989

Related U.S. Application Data

[62] Division of Ser. No. 119,380, Nov. 12, 1987, Pat. No. 4,940,536.

[30] Foreign Application Priority Data

Nov. 12, 1986 [GB] United Kingdom ..... 8626991
Nov. 12, 1986 [GB] United Kingdom ..... 8626992
Dec. 3, 1986 [GB] United Kingdom ..... 8628931

[51] Int. Cl.[5] ..... B07C 5/02; B07C 5/34

[52] U.S. Cl. ..... 209/538; 209/558; 209/564; 209/550; 209/592; 209/939; 356/386; 358/106; 364/478

[58] Field of Search ..... 209/558, 555, 939, 538, 209/552, 580, 592, 559, 564, 566, 587, 546, 551; 358/106, 107, 125; 356/386, 425, 402, 385; 364/478, 555, 560, 564; 382/44, 45

[56] References Cited

U.S. PATENT DOCUMENTS 2,938,626 5/1960 Dahms .
3,814,243 6/1972 Miller .
3,930,995 8/1974 Paddock .
4,254,877 3/1981 Rose .
4,308,959 1/1982 Hoover et al. ..... 209/587 X
4,343,277 9/1982 Cowlin et al. ..... 209/939 X
4,351,437 9/1982 Long ..... 209/939 X
4,493,420 1/1985 Dennis ..... 209/587
4,585,126 4/1986 Paddock .
4,687,107 8/1987 Brown et al. ..... 209/939
4,790,022 12/1988 Dennis ..... 358/106
4,818,380 4/1989 Azegami et al. ..... 209/939

FOREIGN PATENT DOCUMENTS 0105453 9/1983 European Pat. Off. .
0185424 12/1985 European Pat. Off. .
2901970 6/1980 Fed. Rep. of Germany .
3117464 7/1980 Fed. Rep. of Germany .
2530501 1/1984 France .
2040448 8/1980 United Kingdom .
2094489 9/1982 United Kingdom .
2126356 3/1984 United Kingdom .

*Primary Examiner*—Donald T. Hajec
*Attorney, Agent, or Firm*—Cushman, Darby & Cushman

[57] ABSTRACT

Apparatus for sorting articles having a roller conveyor for moving articles through an inspection region where they are scanned by a camera. From the scans, the position of boundaries of the articles is determined so that the existence and location of the articles can be identified. Color counts, representative of the color of the articles are made from the scans and are correlated with the appropriate article identified. Load cells produce weight information which is similarly correlated with the appropriate articles. The information is fed to a processor which is arranged to track the articles through the inspection region and is arranged to route the articles differently in accordance with the color counts and/or weight information correlated therewith.

13 Claims, 12 Drawing Sheets

Figure 1:
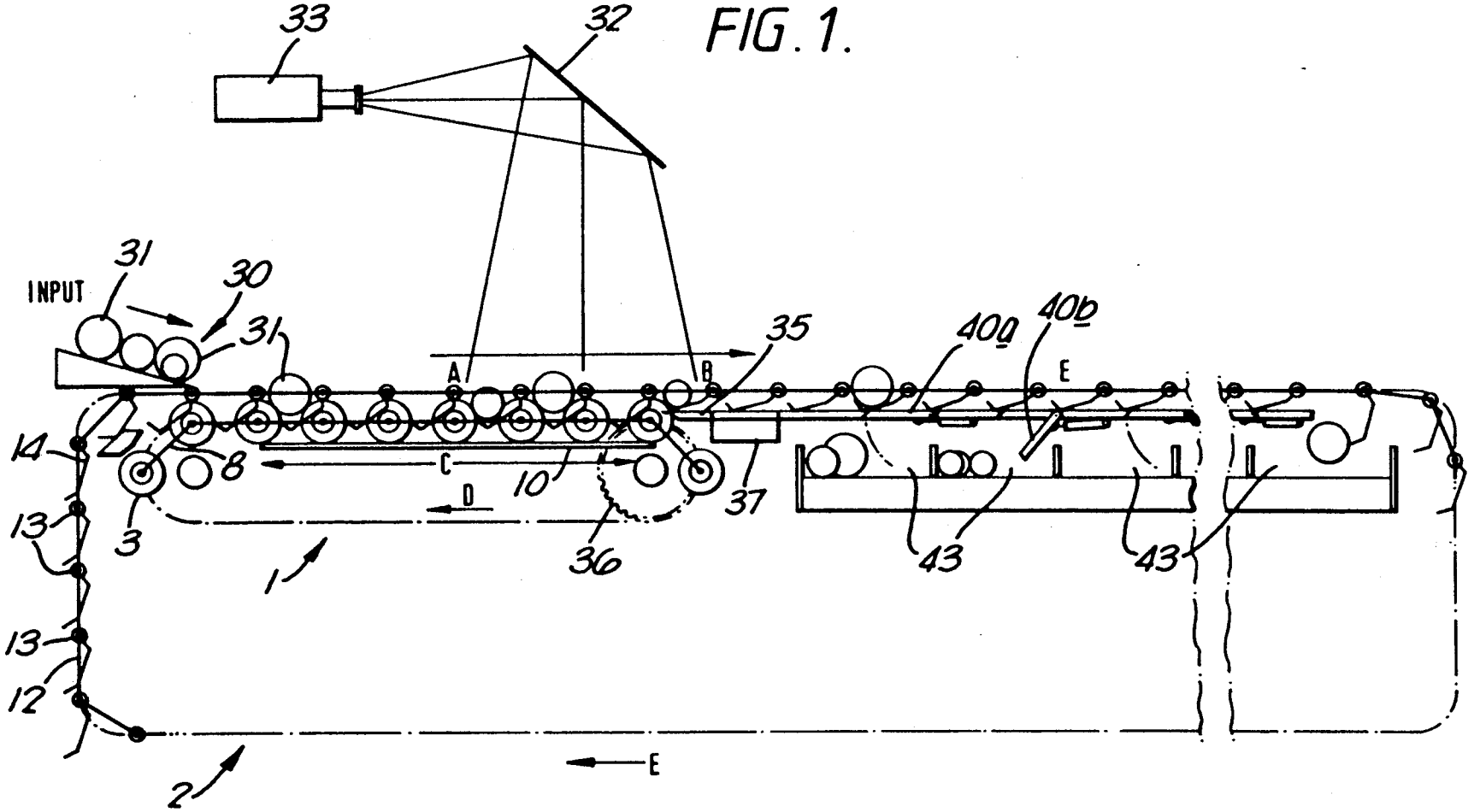

OSCILLOSCOPE
105
X
Y
VIDEO SYNC. GENERATOR
118
TIMING SIGNALS AS REQUIRED

B
R
G
106
S1
IMAGE STORE X
Xd
DAC
S2
IMAGE STORE Y
Yd
ADC
IMAGE STORE Z
107
108
COLOUR LOOK UP TABLE
109
WINDOW GENERATOR
110
TO S1, S2
6
LINEAR MATRIX
104
SWITCH
103
33
G
R
B
LIGHT SOURCE(S)
116a
116b
ROLLER TABLE
1
MOTION
SHAFT ENCODER TIMING
114
AUXILIARY BUS
117
111
68000 PROCESSOR (059)
112
USER TERMINAL

APPARATUS FOR SORTING CONVEYED ARTICLES

This is a division of application Ser. No. 07/119,380, filed Nov. 12, 1987, now U.S. Pat. No. 4,940,536.

The present invention relates to a method and apparatus for sorting articles.

The invention has particular application to the sorting of food products such as vegetables or fruit, in accordance with their size, weight and colour, or the presence of defects on them. Various forms of sorting apparatus for such products have been proposed, for example, apparatus for determining the presence of dark spots on articles is disclosed in European Patent Specification No. 0058028, and apparatus for determining the colour of articles, and colour defects on them is disclosed in European Patent Specification No. 0194148. Both of these earlier specifications describe sorting apparatus comprising a conveyer comprising a plurality of rotatable rollers These known machines are very successful in dealing with certain types of agricultural produce. However, difficulties can arise, particularly with certain articles, and when the apparatus is operating at high speeds, because of the tendency of articles carried by a rotating roller table to move along the rotating rollers, during the progress of the rollers through an inspection region.

Thus, in the apparatus disclosed in European Patent Specification No. 0058028, if a defect in an article is detected at the beginning of the inspection region, the wrong deflectors may be operated in the subsequent section of the machine, if the article moves from side to side along the roller gap during its progress through the inspection region.

The present invention seeks to overcome this difficulty with existing apparatus.

In accordance with the present invention there is provided apparatus for sorting articles, comprising a conveyor comprising a plurality of rotable rollers for supporting the articles, and for causing the articles to pass through an inspection zone, means for rotating the rollers, and thereby rotating the articles, in the inspection zone, inspection means for scanning the articles at at least a first station and a second station in the inspection zone, means for determining from each of the said scans the presence and location of surface features of a desired kind on the articles, and the presence of the boundaries of the said articles on the conveyor, and for determining thereby the number of the said articles, and the position of each article along the respective roller pair, means for storing values associated with the position of the articles at the first station, means for comparing the said stored values with corresponding values associated with the position of the articles at the second station, and for determining thereby the position along the rollers at the first station of articles detected at the second station, means for allocating to each article detected at the second station the said surface features detected at the first station, and means for routing articles differently in accordance with the occurrence of the said surface features.

The invention also extends to a method of tracking articles comprising the steps of scanning the articles at at least a first station and a second station, determining from each of said scans information related to the number and the position of the articles at the respective station, determining specified parameters for each article, storing the number and position information determined from the scan at the first station, assessing from the stored information and from corresponding information related to the number and position of the articles at the second station, the actual number of the articles and their location at the second station, and associating the parameters determined for each article with the appropriate number and position information.

Apparatus in accordance with the invention may be used to determine, for example, defects in the presence of articles, for example green or black spots on the surfaces of potatoes or the like, or ripeness of articles such as tomatoes, for example by investigating the colour of the articles as a whole.

The articles lying between the rollers are scanned, preferably using a conventional t.v. camera, and a raster-scan technique, at at least two, and preferably three or more stations in an inspection zone. For example, if the articles are tomatoes, and it is desired to determine their ripeness, the output from a t.v. camera may be examined, for the occurrence along a scan line of a particular shade of red. By observing large changes in colour, for example between the red of the tomatoes, and the black of the background, the position of the edges of the articles (tomatoes) may be determined.

By noting more subtle changes in colour along the scan lines, for example by noting the difference between deep red and light orange, (for example using the method disclosed in European Patent Specification No. 0194148), the location of colour defects, or of, say, ripe and unripe tomatoes, may be noted.

In accordance with a further aspect of the present invention, there is provided apparatus for sorting articles comprising a conveyor arranged to convey the articles through an inspection region, inspection means for scanning the articles in the inspection region and for determining the presence of the boundaries of said articles, means for determining specified parameters for each article, and means for routing articles differently in accordance with the parameters determined, characterized in that said inspection means is arranged to scan the articles at at least a first station and a second station in the inspection region, and in that said apparatus further comprises means for determining from each of said scans information related to the number and the position of the articles at the respective station, means for associating the parameters determined for each article with the appropriate number and position information, means for storing the number and position information determined from the scan at the first station together with the associated parameters, and means for assessing, from the said stored information and from corresponding information related to the number and position of the articles at the second station and the associated parameters, the actual number of articles, their location at the second station and their associated parameters.

The assessing means may comprise means for comparing the said stored information with corresponding information related to the number and position of articles at the second station and forming an integer-rounded average to represent the number of articles.

Alternatively, the assessing means may comprise means for producing an analogue representation of the number and position of the articles at each of said stations, and means for comparing a dimension of the representation of each article with predetermined minimum and maximum values and adjusting any representations which do not fall within said predetermined values.

By noting the transitions along the scan line allocated to the boundaries of articles, the number of articles present at the first station, and their position along the rollers, may be noted. Values corresponding to their position along the rollers at the first station are then stored, and may be compared with corresponding values at the second station. It is thus possible to determine which of the articles have moved along the roller gaps between the first and second stations.

In this way, the defects or other variations in surface features, for example ripeness, detected at the first station may be allocated to the articles detected at the second station. Since the articles of the second station will in general be in a different rotation position than they were at the first station, it is possible to produce an allocation for each article detected at the second station of surface features observed on both of its sides.

By so arranging the conveyor that the objects are allowed to move freely only within the field of view of the camera, for example by positioning the means for routing the articles immediately after the second scanning station or by otherwise preventing the articles from moving along the rollers after the second scanning station, it is possible to ensure that appropriate actuators are operated to route each article in a desired direction.

In operation of the apparatus it may be that a surface feature is incorrectly classified as a gap between two adjacent articles at either the first or the second station. In general the arrangement will be such that articles may move along the gaps between rollers but not between roller gaps, and therefore the number of articles actually present in any given roller gap will not vary.

In a further aspect of the present invention particularly suitable for use with the apparatus described above, scanning of articles on a conveyor, for example at the first and second stations referred to above, is carried out not along the central part of the gap between adjacent rollers, but in one or more band, offset from the centre.

In this aspect, the invention extends to a method of scanning articles using a raster scan apparatus, the method comprising the steps of scanning a row of articles along at least one band extending along the row, each said band including at least one scan line, and combining the signal values at corresponding points on all of the scan lines of the bands to provide an average value or sum.

Preferably, the row of articles is scanned along at least two spaced bands. In an embodiment, two bands are disposed on either side of the centre line of the row. Each of the said bands preferably comprises a plurality of scan lines, for example eight or more scan lines, and reflectance values for points on adjacent scan lines are averaged to produce a value representative of the average reflectance over each of the two bands for a plurality of points along the articles.

By so disposing the bands along which the articles are scanned, it is possible to differentiate more effectively between articles which lie very close to each other.

A further aspect of the invention relates to the processing of signals derived from a scanning camera, for example a raster-scan RGB television camera, to determine regions of varying intensity in an image, and in particular to determine the gaps between articles, in apparatus as described above. One difficulty which can arise when thresholding techniques are applied to determine the gaps between articles is that there is a very substantial degree of base line drift in the video signal arising from the various parts of the image. This drift can be due to a number of causes, most importantly uneven illumination of the articles across the width of the viewing zone, as well as the possible overlapping or touching of articles. This is overcome in part by the technique described above, of scanning the articles along two bands which are effectively spaced about the centre lines of the articles.

In a preferred embodiment of the invention however, a filtering technique is applied to the signal from each scan line to provide a varying base-line with which the signal from the scan line may be compared by a thresholding technique. In a particularly preferred embodiment the said filtering technique may comprise storing digital values indicative of image intensity in a band of the image, applying to the digital values a non-linear filtering technique, and combining the resulting values with corresponding values obtained by applying the same digital filtering technique to the corresponding digital values, but in which the filtering technique is applied in a time-reversed manner.

In accordance with this second aspect of the invention, there is provided a method of distinguishing regions of varying intensity in an image, which method comprises scanning the image a plurality of times to derive from the image a plurality of digital values, each digital value corresponding to the average image intensity in a band of the image, the said bands being spaced along the direction of scan, storing the said plurality of digital values, applying to the digital values a non-linear filtering technique, the technique being applied to the values in the order in which they are obtained along the direction of scan, applying to the stored digital values a corresponding non-linear filtering technique, the filtering technique being applied to the digital values in the reverse order, combining values obtained from the said forward and reverse filtering methods to obtain a threshold value, and comparing the threshold value with the original sequence of digital values, to distinguish regions of varying intensity in the image.

The term non-linear filtering technique is used herein to refer to a filtering technique in which the output from the filter is treated differently, in accordance with whether successive input values are rising or falling. For example, a first order filtering technique may be applied to each of the said successive digital values.

European Patent Specification No. 0058028 describes a method and apparatus for sorting articles, in which surface defects, for example black spots, are detected on the articles, and different articles are then routed differently, in accordance with whether or not they have such surface defects. The different routing is achieved by means of a bank of pneumatically-operated fingers, which selectively deflect the articles.

Although finger banks such are this are suitable for certain types of fruit and vegetables, for example potatoes, they are not suitable for use with more delicate produce, for example soft fruit.

In accordance with the present invention there is also provided apparatus for sorting articles, which apparatus comprises a first endless conveyor, comprising a plurality of rollers arranged with their axes transverse to the direction of motion of the first conveyor, means for causing the first conveyor to move through an inspection region, means for inspecting articles on the conveyor in the inspection region, means for causing rotation of the rollers in the inspection region, thereby to cause rotation of the articles in the inspection region, means for conveying said articles to a sorting zone provided with at least one bank of actuators for causing or permitting respective ones of the articles to be deposited, and means responsive to said inspecting means for controlling said actuators said apparatus being characterised in that a second endless conveyor is provided, said second conveyor having a plurality of carriers pivotally mounted for movement with the second conveyor, on pivot axes transverse to the direction of motion of the second conveyor, a plurality of the said carriers being provided on each said pivot axis, the pivot axes of the carriers being spaced apart, in that the first and second conveyors are arranged to move together over a first part of the travel of the second conveyor such that a plurality of coaxially pivoted carriers are located between a respective pair of rollers of the first conveyor, in that the path of the first and second conveyors is such as to cause the carriers to lift the articles from between the respective pair of rollers, and convey the said articles to said sorting zone in a second part of the travel of the second conveyor, and in that actuation of said actuators causes or permits movement of respective ones of the carriers to cause or permit the articles carried therein to be deposited.

The apparatus of the invention not only alleviates the need for singulation of the articles being sorted, it also enables the articles to be deposited from the carriers with minimum risk of damage.

Data processing means are preferably provided to assess not only the position of articles across the width of the rollers, but also the size of each article in relation to the size and position of the carriers. By this means, one, two or several actuators may be operated together to deposit articles larger than one carrier. By arranging for the size of the carrier to be such that only a single one of the smallest size articles which it is desired to sort will rest on each, the need for singulation of the articles can be avoided.

In a preferred embodiment of the invention, apparatus for carrying and enabling deposit of articles comprises a plurality of carriers for said articles, means for moving the carriers over a support surface, the carriers being pivotally mounted on pivot axes extending transversely to the direction of movement of the carriers, at least one opening in said support surface, and first and second cooperable means arranged to open and close said opening, wherein, during their movement thereover, the support surface is arranged to support the carriers, and the opening of said opening removes support from one or more respective carriers which are pivoted thereby to cause or permit any articles carried therein to be deposited.

Figure 2:
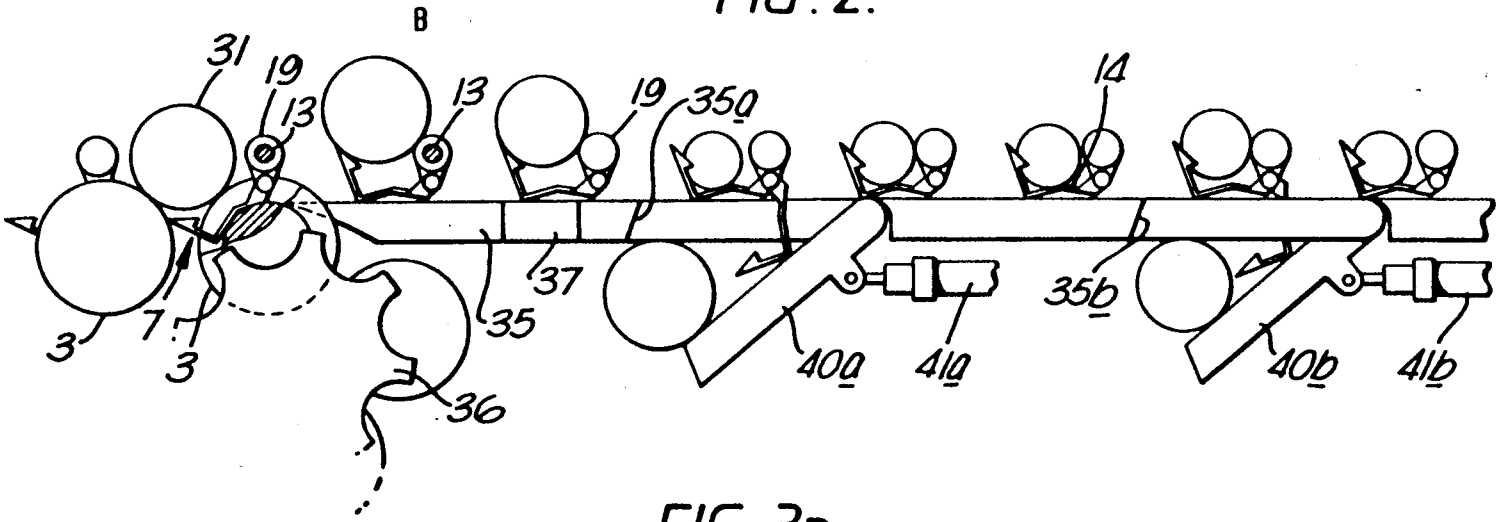
Figure 3A:
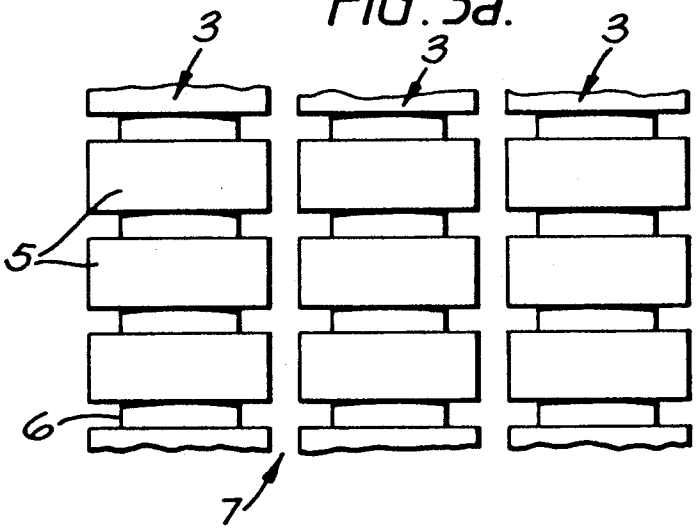
Figure 3B:
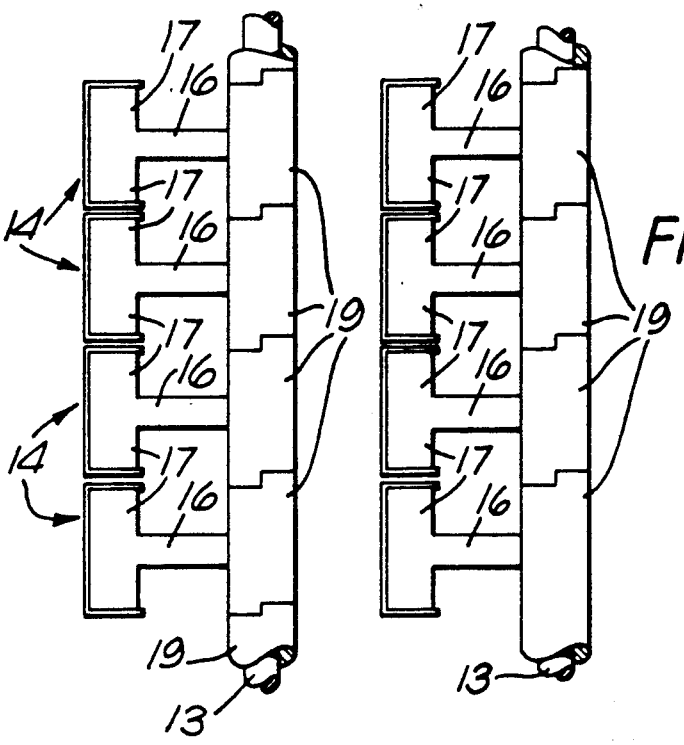
Figure 3C:
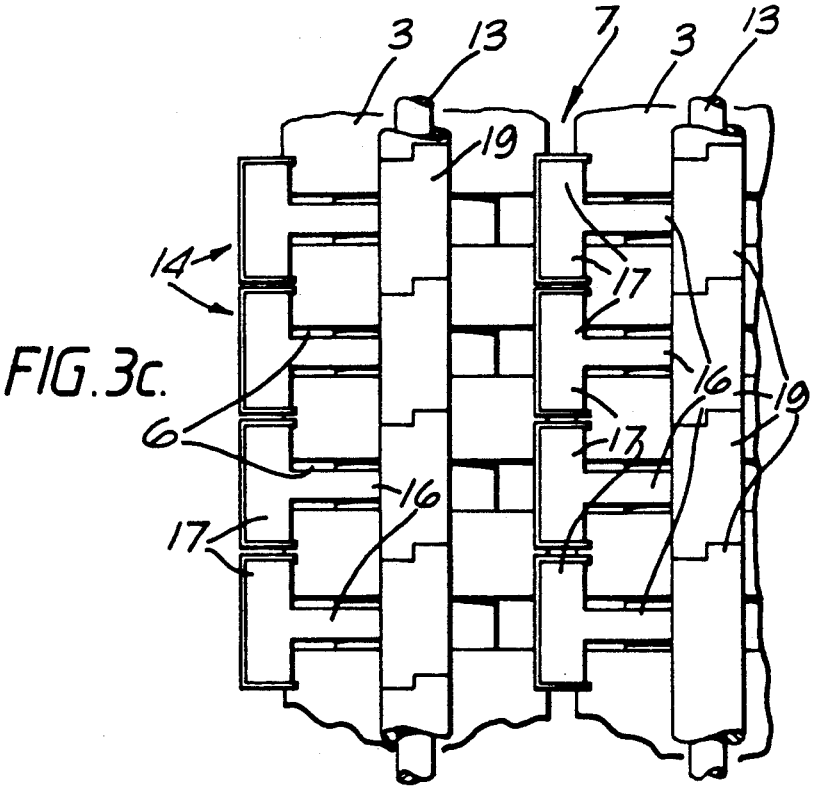
Figure 4A:
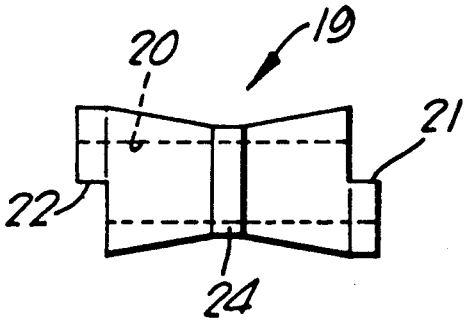
Figure 4B:
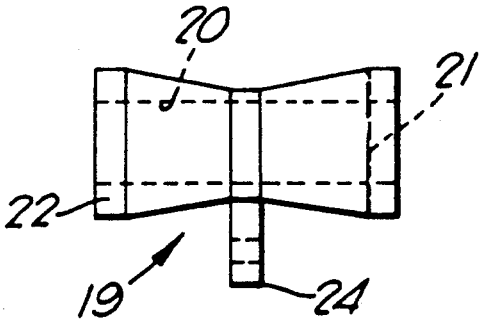
Figure 4C:
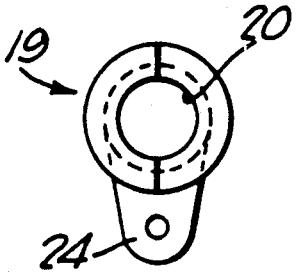
Figure 5A:
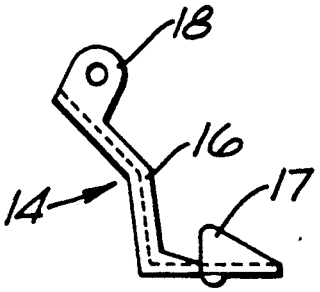
Figure 5B:
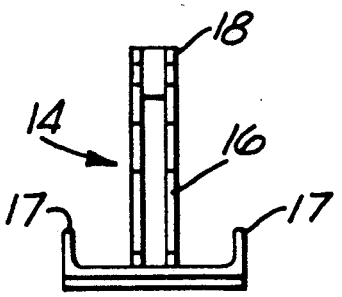

Embodiments of the present invention will hereinafter be described, by way of example, with reference to the accompanying drawings, in which:

FIG. 1 shows a general schematic diagram of sorting apparatus of the invention, FIG. 2 is an enlarged view of part of the apparatus of FIG. 1, FIGS. 3*a*, 3*b* and 3*c* are schematic plan views of part of the apparatus of FIG. 1, FIGS. 4*a*, 4*b* and 4*c* are respectively side elevation, plan, and end elevation of a bracket for a carrier for use in the apparatus of FIG. 1, FIGS. 5*a* and 5*b* are respectively side and front elevations of a carrier for use in the apparatus of FIG. 1.

Figure 6A:
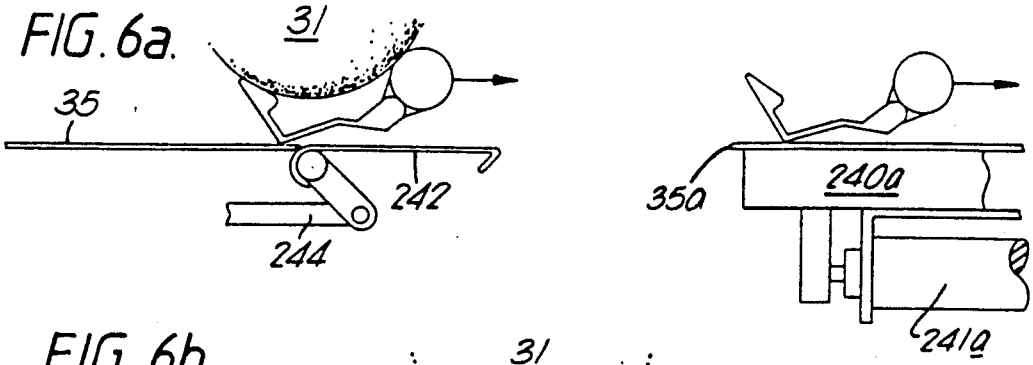
Figure 6B:
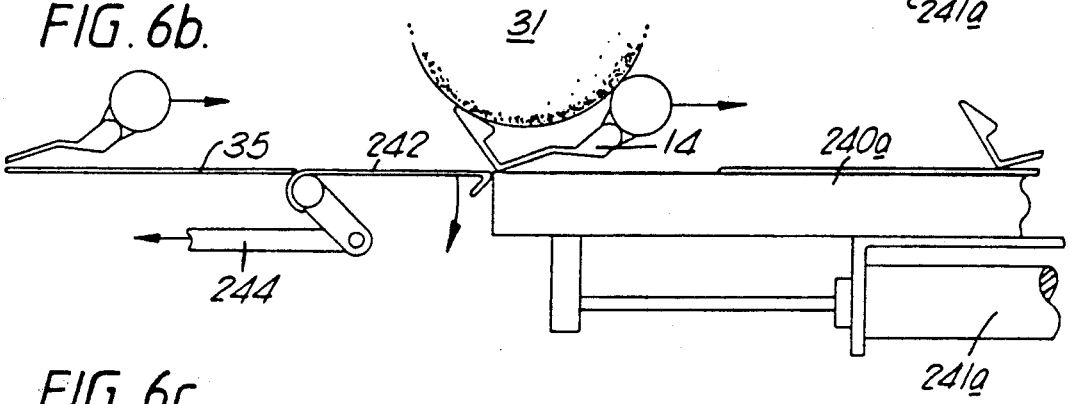
Figure 6C:
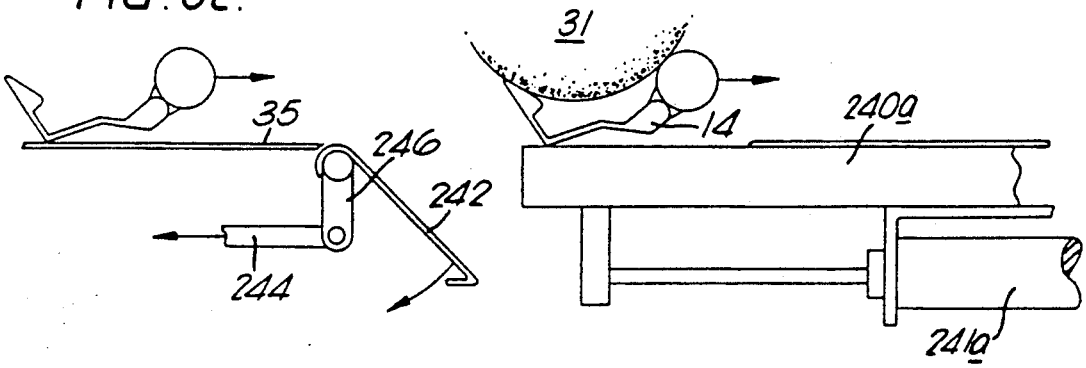
Figure 6D:
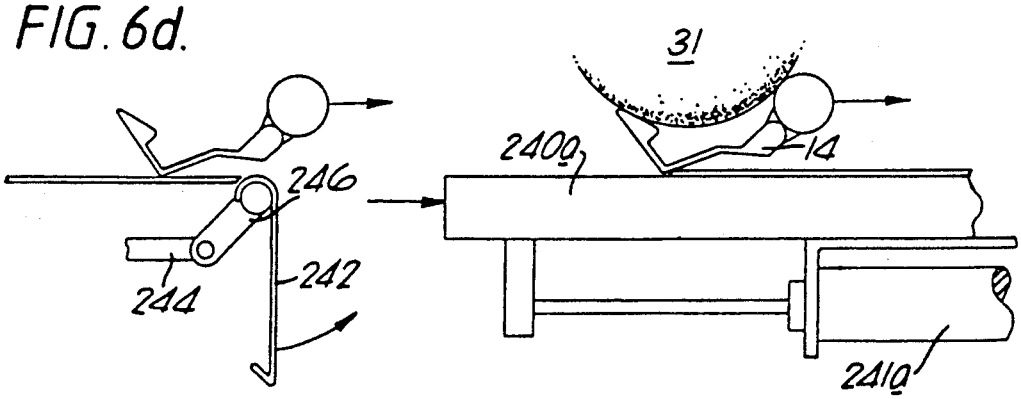
Figure 7A:
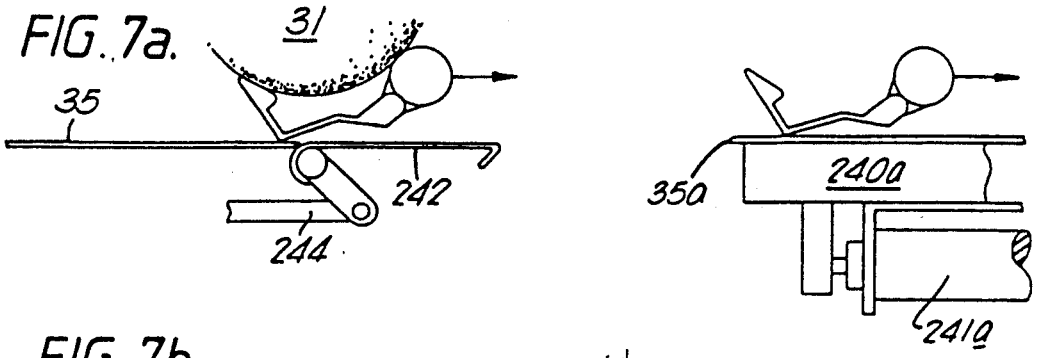
Figure 7B:
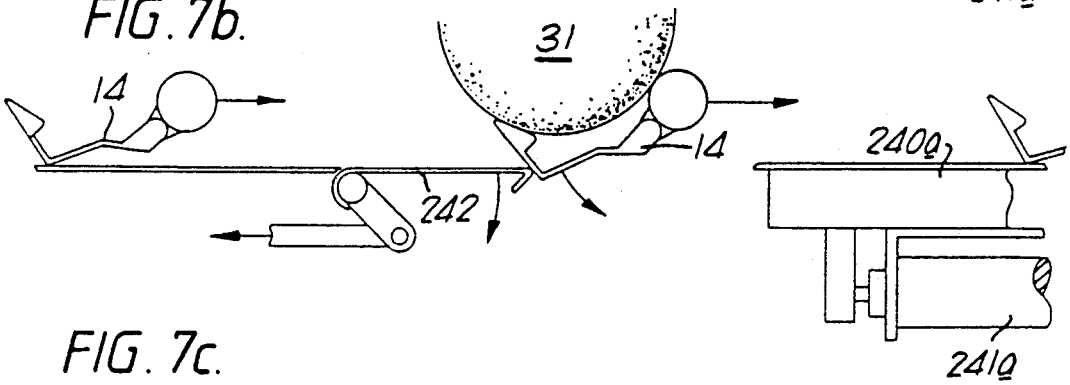
Figure 7C:
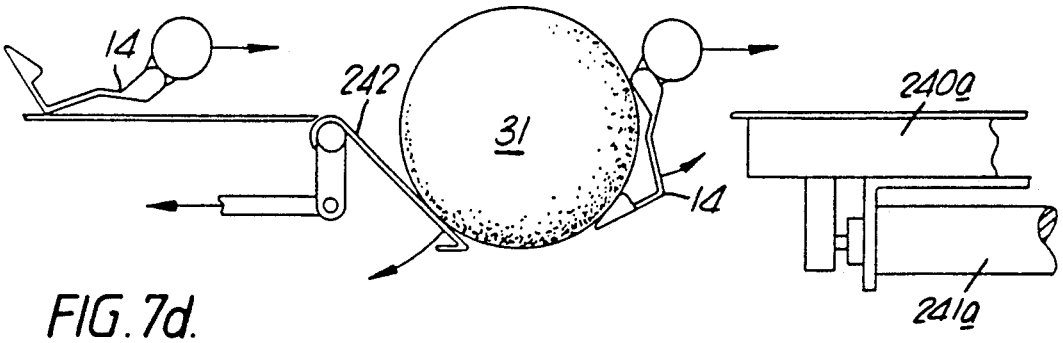
Figure 7D:
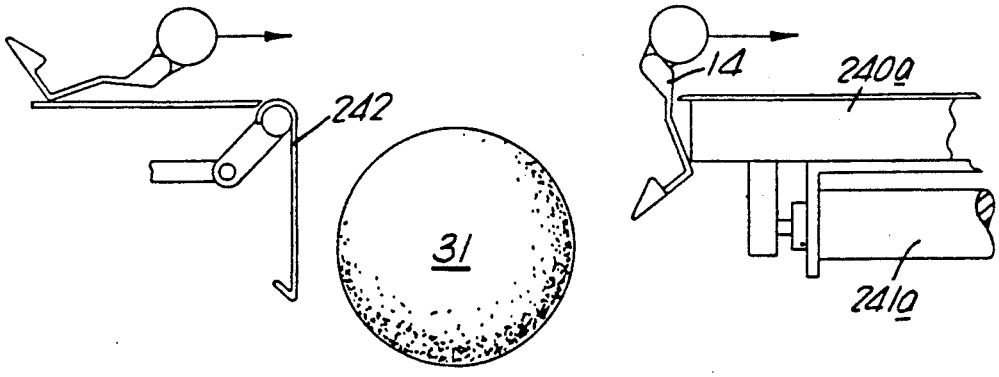
Figure 8:
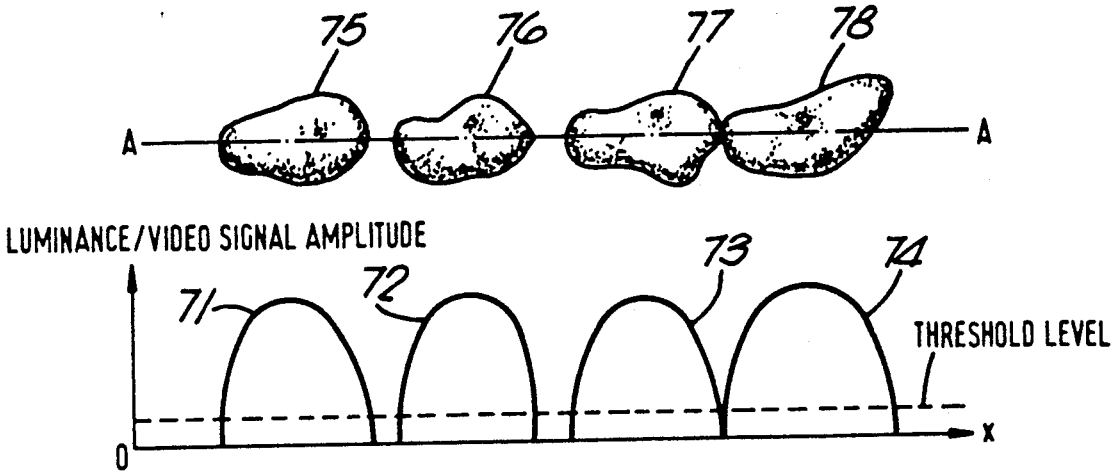
Figure 12:
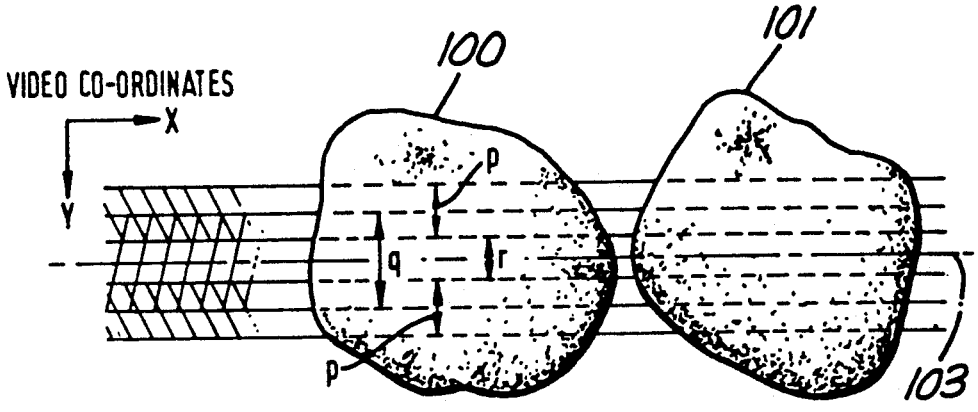
Figure 9:
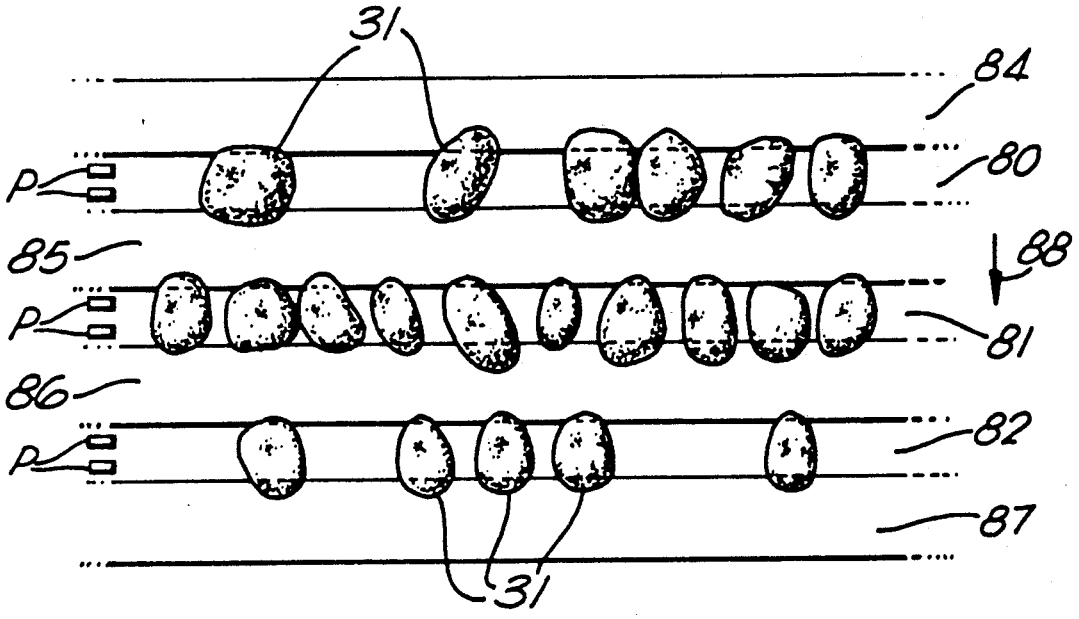
Figure 10:
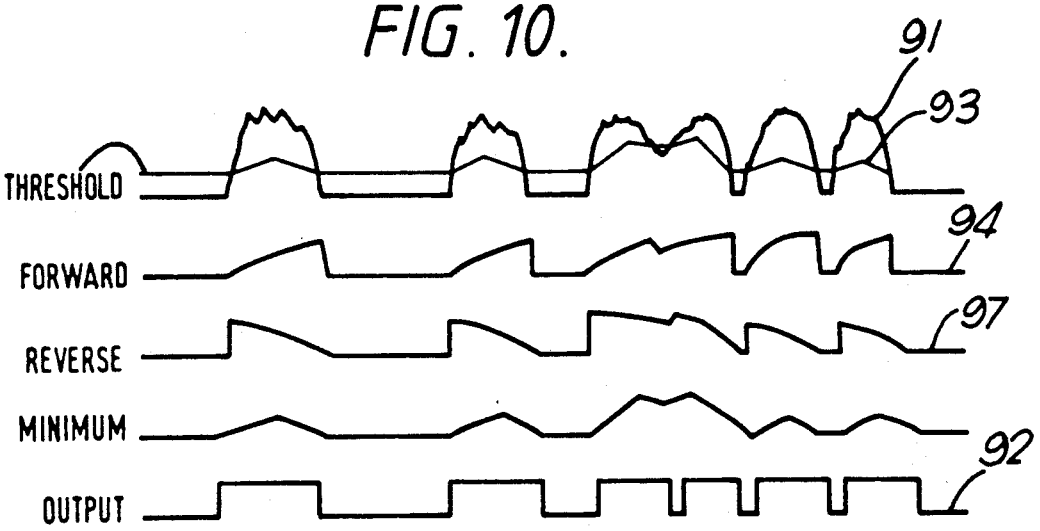
Figure 11:
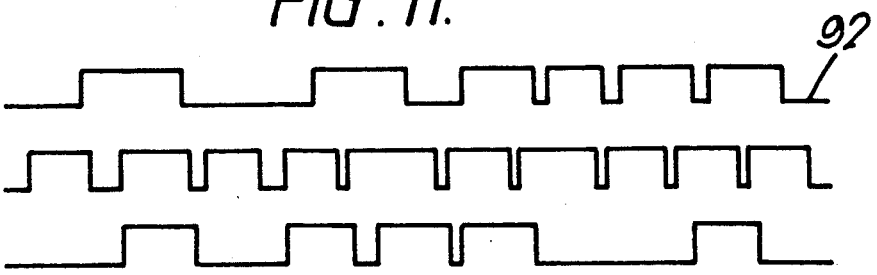

FIGS. 6*a*, 6*b*, 6*c*, 6*d* illustrate an alternative arrangement of actuators for apparatus of the invention and show the sequence of operations for preventing deposit of an article, FIGS. 7*a*, 7*b*, 7*c*, 7*d* illustrate the actuators of FIGS. 6*a* to 6*d* and show the sequence of operations for depositing an article, FIG. 8 illustrates an ideal luminance profile produced by a number of articles along a scan line of a t.v. camera, FIG. 9 shows three rows of objects positioned on rollers, FIG. 10 shows an actual luminance profile for one row of the articles of FIG. 9 together with corresponding profiles after processings, FIG. 11 illustrates three output profiles after processing for the articles of FIG. 9, FIG. 12 illustrates a preferred method for the scanning of articles.

Figure 13A:
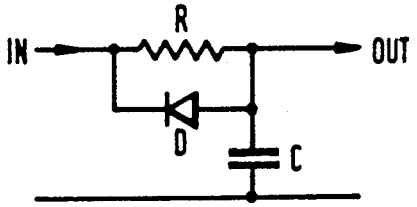
Figure 13B:
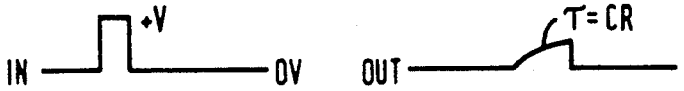
Figure 13C:
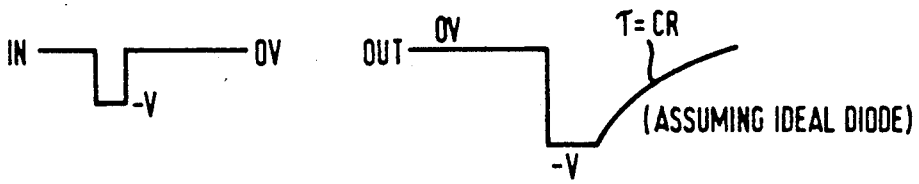
Figure 14:
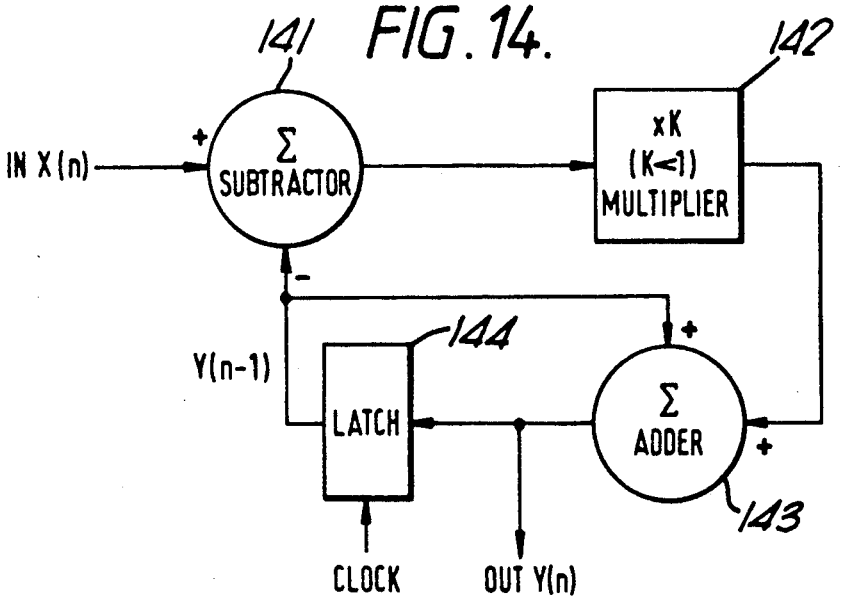
Figure 15:
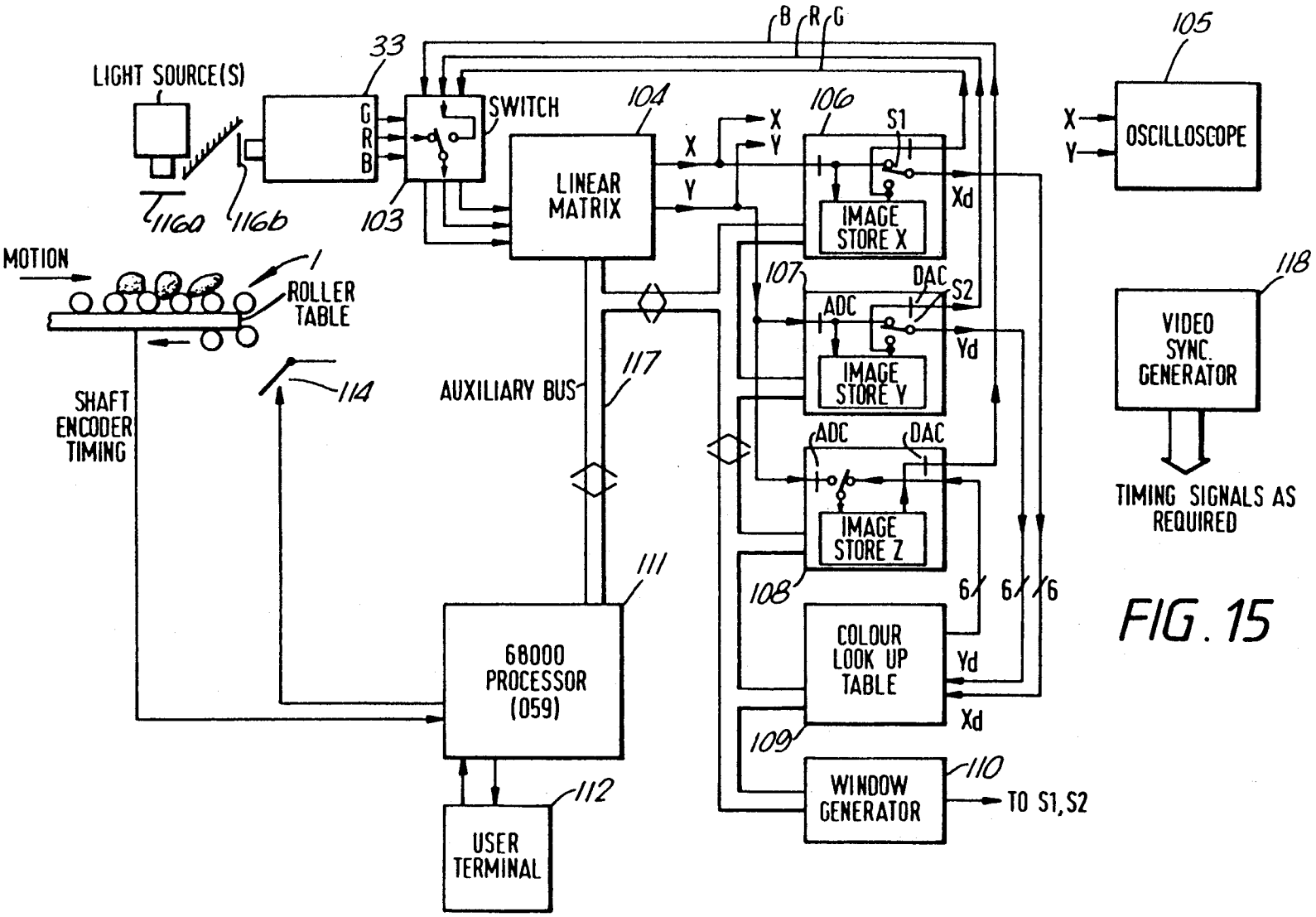
Figure 16:
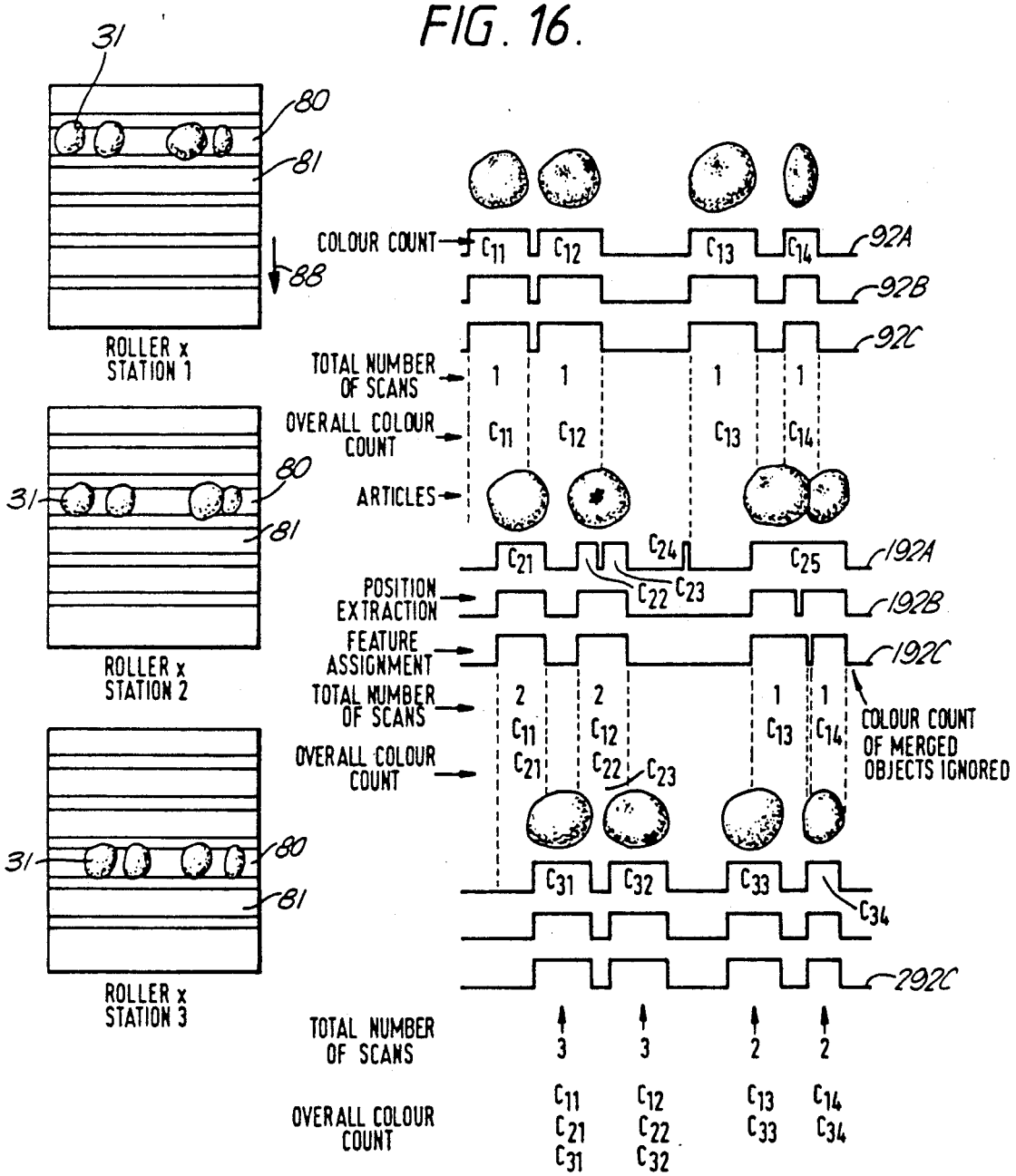
Figure 17:
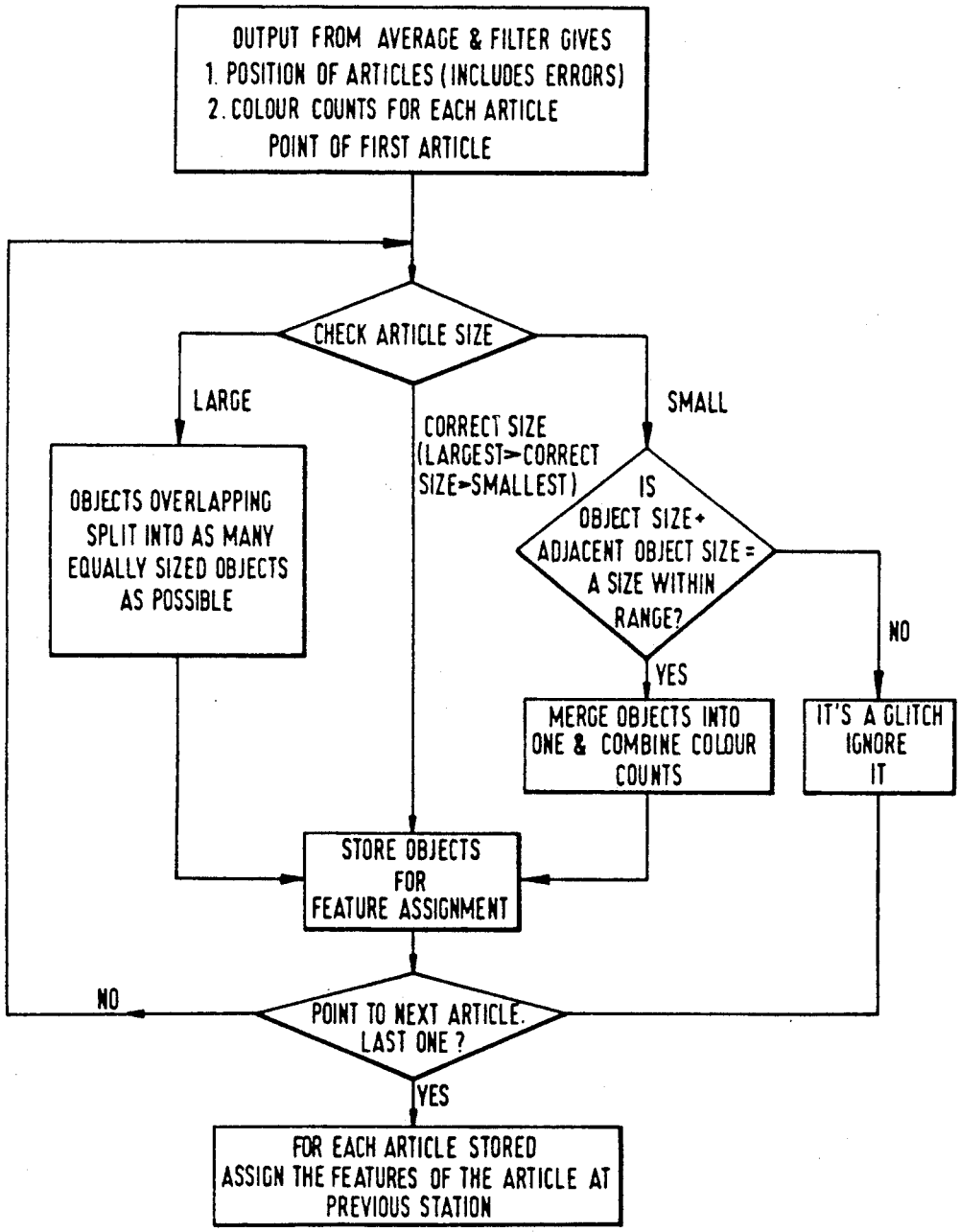

FIG. 13*a* is an analogue representation of a non-linear first order filter, FIGS. 13*b* and 13*c* represent typical response characteristics of the filter of FIG. 13*a*, FIG. 14 shows a digital implementation of a first order recursive filter, FIG. 15 is a schematic representation of the overall electronic arrangement of the preferred apparatus in accordance with the invention, FIG. 16 schematically illustrates the tracking method used by the apparatus of the invention, and FIG. 17 shows the algorithm for the tracking method which is performed by the computer software.

Referring to FIGS. 1, 2 and 3, apparatus for sorting articles comprises a first conveyor 1 and a second conveyor 2, the second conveyor being substantially longer than the first, and the two conveyors being arranged to move together over length C of their travel. Conveyor 1 comprises a plurality of rollers 3, orientated with their axes tranverse to the direction D of movement of the conveyor 1. Each of the rollers 3 has a grooved construction, as shown in more detail in FIG. 3*a*. Thus, each roller 3 comprises a number of raised portions 5, separated by a number of grooves 6. A gap 7 is defined between each pair of rollers 3, for carrying the articles to be sorted. If required, the articles can be caused to rotate by rotating the rollers. The method of location of the articles will be described in more detail hereinafter.

The rollers 3 are caused to move by an endless chain 8, linking the respective axes of the rollers 3. In this embodiment, the rollers 3 pass over a fixed support 10, on which they rest over the portion C of their movement, and are thereby caused to rotate.

The outer conveyor 2 similarly comprises an endless chain 12, joined to a number of shafts 13. The pitch between shafts 13 is equal to the pitch of the rollers 3 in conveyor 1, and conveyors 1 and 2 are driven by appropriate sprocket drives, one only of which is indicated at 36, so that they move together through region C, with rollers 3 and shafts 13 in alignment.

Each of shafts 13 supports, in the embodiment illustrated, sixteen carriers 14, for the articles to be sorted, spaced across the width of the conveyor 2. The carriers are illustrated in more detail in FIGS. 5*a* and 5*b*. Each carrier comprises an elongate leg portion 16, two arms 17, and a pivot support portion 18. The carriers 14 are pivotally mounted on support brackets 19, the shape of which is illustrated in FIGS. 4*a*, 4*b* and 4*c*. Support brackets 19 are not illustrated in FIG. 1, for clarity, but their arrangement is shown in FIG. 2, which will be described in more detail hereinafter. Support brackets 19 have a central hole 20 to accommodate shafts 13, and a pair of shoulders 21 and 22, to prevent rotation with respect to each other of the sixteen brackets 19 mounted on each shaft 13. Depending from each bracket 19 is a carrier support arm 24, on which the respective carriers 14 are pivoted.

The arrangement of brackets 19 and carriers 14 is illustrated in FIGS. 3*b* and 3*c*. As described above, FIG. 3*a* is a schematic plan view of three rollers 3, showing grooves 6. In FIG. 3*a*, for clarity, the shafts 13 and the carrier arrangements are not shown. Similarly, FIG. 3*b* illustrates the carrier and bracket arrangement, and in particular shows a plurality of carrier brackets 19 arranged on shafts 13, each bracket 19 supporting a respective carrier 14. In FIG. 3*b*, the rollers 3 are not shown for clarity.

FIG. 3*c* illustrates the juxtapostion of the two conveyors 1 and 2, and thus the rollers 3, and shafts 13, in the region C in FIG. 1. As can be seen, the legs 16 of carriers 14 are arranged so as to lie in grooves 6 of rollers 3, and arms 17 are arranged so as to rest in the gaps 7 between rollers 3.

By rotating slightly the assembly of brackets 19 on shafts 13, the precise position of the pivot axes of brackets 14 along the direction of movement of the conveyor 2 can be adjusted. The length of the carrier support arms 24 is such that the pivot axes of carriers 14 are below the top of raised portions 5 of the rollers 3. Because of this low positioning of the pivot axes of carriers 14, when carriers 14 are lifted, so as to raise articles in the gaps 7 between rollers 3, they lift the articles almost vertically, and any inclination to push the articles backwards is minimised.

It can be seen from FIG. 1 that as rollers 3 and carriers 14 enter region C, carriers 14 are caused to lie between and below rollers 3, such that articles of a suitable size are supported by rollers 3, rather than by carriers 14. In this respect, it will be seen that the articles to be sorted must have an overall size less than the clearance between shafts 13, but greater than the gap 7 between rollers 3.

In an alternative embodiment (not shown) larger articles may be accommodated by making the spacing of carriers 14 equal to twice that of rollers 3. In this case, further shafts may be provided associated with conveyor 1, to prevent articles from occupying alternative gaps between the rollers. Alternatively, in this embodiment, the shafts 13 may be caused to be in alternate roller gaps so as to prevent articles resting therein, and arms 24 may be so angled as to provide a substantial horizontal offset of the pivot axes of carriers 14 from shafts 13.

Articles 31 to be sorted are deposited upon conveyor 1 at point 30. The articles 31 thus pass through an inspection region A-B, as illustrated in FIG. 1. In inspection region A-B, the articles 31 are illuminated by a light source (not shown) and are viewed by a raster-scan television camera 33 by way of a mirror 32. As they pass through the inspection region A-B, the articles 31 are caused to rotate, so that various blemishes and defects on their surface can be located. Of course, in some applications, such rotation of the articles is not necessary and need not be caused.

The colour of the articles, and the presence of any colour defects, may be detected for example, using methods as described in European Patent Specifications Nos. 0058028 and 0194148.

At point B shown in FIG. 1, conveyors 1 and 2 separate, the rollers of conveyor 1 returning along a lower part of their path, and the carriers of conveyor 2 being supported by a support surface 35. This is illustrated more clearly in FIG. 2, which is a schematic diagram of the region B-E of FIG. 1, with the drive chain removed for clarity. As can be seen from FIG. 2, rollers 3 are supported by sprocket 36, and return along the lower part of the path of conveyor 1. A shaft encoder (not shown) is associated with sprocket 36, and a computer stores information relating to the position of the respective articles 31 along the rollers 3, in the region of point B, the respective sizes of the articles located in each carrier 14, and other information relating to colour, the presence of blemishes etc., as will be discussed in more detail below.

Carriers 14 slide along the upper surface of the support 35, and over an array of load cells 37. The computer correlates the weight information produced by the load cells 37 so that, for each carrier 14, the computer stores values indicative of the size, weight, density and colour of any article present, and of whether any blemishes are present on its surface. The location of the extremities of each article with respect to the various carriers is also stored.

After passing over the load cells 37, the carriers 14 are passed over a number of banks of fingers 40*a*, 40*b* etc. As many banks of fingers are provided as categories into which it is desired to sort the articles 31, and sixteen fingers are provided spaced across the conveyor, in each bank. Each finger 40*a*, 40*b* is operated by a respective pneumatic actuator 41*a*, 41*b*. etc.

Each bank of fingers 40*a*, 40*b* is arranged to open and close a respective opening 35*a*, 35*b* in the support surface 35, each such opening being positioned over a corresponding compartment 43 (FIG. 1), for receiving articles 31 of a particular size, weight or colour classification. When the carriers 14 are positioned over the finger 40 corresponding to the appropriate compartment 43, the corresponding pneumatic actuator 41*a*, 41*b*, is operated, so as to deposit the article 31 into the corresponding compartment 43.

The clearances between the fingers 40, and the compartments 43 are such that the articles 31 are dropped only a relatively short distance, to avoid damage. Timing of the actuators 41*a*, 41*b*, is governed by the computer, in synchronization with the shaft encoder.

One or more conveyors (not shown), for example running laterally of conveyors 1 and 2, may be provided within the compartments 43 to convey the articles 31 to appropriate storage receptacles.

At the end of the support surface 35, all the carriers 14 are allowed to fall, so as to deposit all the remaining articles 31.

The fingers 40, and the openings in the support surface 35 which they control have a size which is determined by the size of the articles to be sorted by the apparatus. Where the apparatus is designed for use with larger articles, the increased size of the fingers 40 and of the openings 35*a*, 35*b*, can produce timing problems. FIGS. 6 and 7 illustrate an alternative arrangement having a fast and reliable action which is particularly useful when sorting larger articles.

FIGS. 6 and 7 show schematically the operation of a single finger 240*a* of the alternative arrangement. However, as previously, each opening, as 35*a*, extending across the support plate 35, and associated with a respective compartment 43, is opened and closed by a bank of fingers, as 240*a*, spaced across the conveyor. Again, and as previously, a number of these banks of fingers are generally provided. However, in this embodiment, the fingers are reciprocable rather than pivotable.

FIG. 6 illustrates the operation of one finger 240*a* when deposit of an article 31 into a corresponding compartment, as 43 (FIG. 1), is not required. FIG. 7 shows the sequence of events in the case where it is required to deposit the article.

Along the upstream, transversely extending, edge of the or each opening, as 35*a*, there is provided a flap member 242 whose width is at least the same as that of the corresponding bank of fingers 240*a*. This flap 242 is mounted to pivot from a position as shown in FIG. 6*a* in which it substantially prolongs the support surface 35, to a position as shown in FIG. 6*d* in which it extends substantially at right angles to the support surface 35. Movement of the flap 242 between these two positions is caused by reciprocation of a crank 244 which is pivotally connected to a cam 246 of the flap 242.

It will be seen from the sequence illustrated in FIGS. 6*a* to 6*d* that initially the flap 242 extends level with the support surface 35 whereas the finger 240*a* is placed in a retracted position by way of a respective pneumatic actuator 241*a*. If the computer determines that the next article 31 approaching any particular finger, as 240*a*, is not to be deposited, the pneumatic actuator 241*a* is controlled to extend the finger 240*a* in a direction substantially parallel to the plane of the support surface in a direction opposite to that of the transport direction of the articles 31. As can be seen in FIG. 6*b*, the extended finger 240*a* and the extended flap 242 together form a support surface for the carrier 14 of the article 31. As the carrier 14 moves over and away from the flap 242, the flap is pivoted downwardly as shown in FIG. 6*c*, and subsequently in FIG. 6*d*. However, during this downward movement of the flap 242, the carrier 14 is supported by the extended finger 240*a*.

When the flap 242 reaches its end position as shown in FIG. 6*d*, the crank 246 causes it to return towards its level position. Simultaneously, retraction of the extended finger 240*a* by way of the actuator 241*a* is commenced.

FIGS. 7*a* to 7*d* show the sequence of events where deposit of an article 31 approaching a finger 240*a* of a finger bank is required. It will be seen from FIGS. 7*a* to 7*d*, that the flap 242 is constrained to follow exactly the same sequence of movements as described above with reference to FIGS. 6*a* to 6*d*. However, where deposit of the article is required, the finger 240*a* is not moved to support the carrier, but remains in its initial position. Thus, as the flap 242 moves to its end position, substantially at right angles to the support surface 35, support is removed from the carrier 14 such that it pivots downwardly and deposits the article 31. As can be seen in FIG. 7*c*, the article being deposited tends to be guided by the lowering flap 242.

It will be appreciated from consideration of FIGS. 6 and 7 that the article being deposited is always kept away from the edges of the opening 35*a* such that damage thereto by this edge is not possible. It should also be appreciated that the timing sequence and control for the flap 242 and the finger banks is relatively straight forward.

FIG. 8 illustrates schematically in its upper part four adjacent articles 75, 76, 77, 78 spaced along a scan line A—A of a raster scan television camera, and in its lower part an idealised luminance profile along line A—A of the raster scan. The theoretical, (and desirable) luminance profile consists of four smooth peaks, 71, 72, 73 and 74, one for each article.

FIG. 9 illustrates a typical view which might be seen through television camera 33, showing four rollers 84, 85, 86, 87, supporting a number of articles 31, in this case, potatoes. FIG. 10 illustrates the actual luminance profile 91 obtained from video camera 33, for scan lines along the centre of the gap 80 between rollers 84 and 85 shown in FIG. 9, that is, for the top row of articles 31 as seen in FIG. 9. It will be seen that a peak in the luminance profile 91 can be seen for each of the articles 31. However, a simple straight threshold line 93 drawn through any of the luminance profiles of FIG. 10 would not be capable of detecting with certainty where the limits of an article lies. In particular, it will be seen that, at places, the luminance trace 91 in FIG. 10 does not return to the base line, both because of variation of illumination between the edges and the centre of the picture, and because of the touching and overlapping of certain of the articles 31.

The desired output from the device, which indicates both the size and the location of the potatoes shown in the top row of FIG. 9 is the output trace 92 illustrated in FIGS. 10 and 11. Two techniques are utilised, as will be described with reference to FIGS. 10, 12, 13 and 14 for providing the output trace 92 which has improved discrimination between adjacent objects.

FIG. 12 shows schematically, two adjacent articles 100, 101, between which it is desired to discriminate. The rollers are omitted for clarity. Discrimination between the articles is improved in accordance with this aspect of the invention by scanning not along the centre line 103 of the roller gap, but instead along two bands p offset from this centre line 103.

Each band p is composed, in the embodiment illustrated, of eight lines of the raster scan. The signal values at corresponding points on the sixteen scan lines are combined to give an average value or sum, which is used to determine the limits of the articles. The signal which is utilised will in general be a linear or non linear combination of the raw R, G, B signals, the combination being chosen to minimise differences between articles of different colours.

As can be readily seen from FIG. 12, because the articles are generally rounded in shape, the emphasis given to the gaps between articles when measurement is made along two separated bands is far greater than would arise if measurement were made along a single band of the centre line 103 of the roller gap.

This technique compensates to some extent for touching and overlapping articles, but is not able to improve substantially the position caused by baseline drift due to uneven illumination or varying object reflectance.

A technique by which this problem may be overcome is illustrated with reference to FIGS. 10, 13*a*, 13*b*, 13*c* and 14. FIG. 13*a* is a typical analogue representation of a non-linear first order filter. The essential response characteristics of such a filter are illustrated in FIGS. 13*b* and 13*c* respectively As can be seen from FIG. 13*c*, when the input signal is greater than the present output, the filter of FIG. 13*a* produces an exponential smoothing of positive-going steps. However, a negative-going step, if it forward biases the diode, is passed directly to the output. Thus, if a profile such as the luminance profile 91 of FIG. 10 is input to the filter of FIG. 13*a*, a trace, similar to the trace 94 shown in FIG. 10, will appear at its output.

A typical digital implementation of a first order recursive filter is illustrated in FIG. 14. The digital filter of FIG. 14 comprises a subtractor 141, a multipler 142, an adder 143 and a latch 144. It will be readily seen that, by appropriate choice of the various constants, the output Y(n) is given by $$Y(n)=Y(n-1)+K\cdot((X(n)-Y(n-1)).$$

Where X(n) is the current input, Y(n−1) is the output for the previous sample, and K is a constant multiplier between 0 and 1. For an input impulse of amplitude a, the filter output sequence is $Y(n)=a\cdot K^n$.

A simple and fast method of implementing the multiplier 142 is by means of a lookup table in random access memory (RAM). This method of implementation is also useful in that it renders the digital equivalent of the diode in FIG. 13*a* particularly straightforward to implement. An appropriate characteristic is loaded into the lookup table, such that for positive input X, the output is K·X, while for negative inputs, the output is equal to X.

The implementation of the multiplier in a lookup table has the additional advantage that, if desired, K may be made to vary in an entirely arbitrary way, as a function of the input to the lookup table, to provide more complex non-linear filtering characteristics.

The numerical processing is preferably carried out on data samples in integer form, and the multiplier characteristics may be represented in nine bits allowing an output range between −255 and +255. The lookup table is called upon to generate as an output a fraction of its input data. The value 1/32 is frequently used in operation, and the resulting rounding error can be quite large. This results in a danger that the output will contain a "dead band" around an input of zero (in the case described, for all inputs between −15 and +15). This may preferably be overcome by replacing zeros in the lookup table by ones, except for the case where the input is actually equal to zero. The effect of this is to replace the dead band effect with one very similar to slew-rate limiting in analogue operational amplifiers, or slope overload in a digital delta modulator. Since the output of the non-linear filter is equal to its input at minima, the actual threshold to be used for comparison is obtained by adding a constant offset. Choosing an offset of zero is not possible because noise gives rise to multiple local minima. If low-level random variations are particularly severe, an element of hysteresis can be introduced by varying the offset in a sense opposite to that of the logical output from the comparator. This has a minor disadvantage in that it introduces a slight asymmetry which may be overcome by again performing the comparison process in both forward and reverse directions.

In practice, the filter operation is carried out as follows. Each of the rows 80, 81 and 82 of potatoes in FIG. 9 is scanned, using a scan pattern as illustrated in FIG. 12. In practice, the whole of the area visible to the video camera is scanned, but data processing means is so arranged as to ignore all scans of the image, except when the line corresponds to a desired scan line, as shown in FIG. 12. In FIG. 9, the articles 31 lie in three gaps, 80, 81 and 82, between rollers 84, 85, 86 and 87 respectively. The rollers are represented schematically, for clarity.

The analogue signal from each scan line is digitised using an analogue-to-digital convertor, and the values from vertically adjacent points are summed in each of two bands p for each gap, 80, 81 and 82 as described above with reference to FIG. 12. This vertical summing or averaging may be performed either in software or hardware (not shown) and produces for each row of articles a waveform (not shown) which is similar to the trace 91 of FIG. 10 but with a substantial reduction in noise and improvement in offset delineation.

The resulting 256 digital values obtained for each combination of two bands 'p' are stored in Random Access Memory (RAM), and applied to a digital filter of the kind shown in FIG. 14 in the order in which they are obtained. The resulting filtered signal for gap 80 is shown in FIG. 10 as the trace 94. Corresponding filtered traces (not shown) are obtained for each of gaps 81 and 82. The same digital filtering technique is then repeated, but taking the digital values in reverse order along the scan line (i.e. in a "time reversed" fashion). The resulting filtered signal for the trace in gap 80 with the points taken in reverse order is shown in FIG. 10 as trace 97. Again corresponding traces (not shown) are obtained for gaps 81 and 82.

Traces 94 and 97, are then combined by taking for example their average, maximum, or, preferably, the minimum value of the two traces. The minimum value is preferable, because it maximises the difference between raw and filtered data when the original sample values are high. The resulting filtered and combined signal provides a moving threshold, which is compared with the actual vertically averaged traces in bands 'p' to enable discrimination between objects. Thus, the position and location of objects in the roller gaps for each of the roller gaps 80, 81 and 82 is determined.

The rollers 84, 85, 86 and 87 move down the picture in the direction of arrow 88.

FIG. 16 schematically illustrates the tracking method used, and FIG. 17 shows its algorithm which is performed by the computer software. The tracking technique illustrated is particularly advantageous as it enables decisions to be made about the article information being received during tracking. By this means, the reliability of the sorting process is enhanced.

FIG. 16 shows the situation when a number of articles 31 are positioned in the first roller gap 80. As previously, the vertical averaging and filtering techniques described provide an output trace 92A. Generally, each leading and trailing edge of the trace 92A is taken to show the position of the periphery of an article such that output trace 92A correctly identifies the existence and location of four articles 31. In addition, the results of any colour measurements which have been made are correlated with the identified articles. In the example of FIG. 16 an accumulated colour count of the form $C_{nm}$ is produced where C is the average value of the colour identified, n is the number of the roller gap, and m is the number of the article at that gap.

We have seen from the above how the position and location of articles in a roller gap, as 80, can be determined. In addition, the information received from the video camera 33 is utilized to determine the colour of the articles and to indicate if any colour defects are present or absent. Furthermore, the load cells 37 produce weight information in respect of the articles 31.

It will be appreciated that the information generated needs to be correlated with the articles to which it relates such that, by the time the articles reach the sorting zone B-E, they can, by actuation of actuators 40, 240, be deposited into the appropriate compartments 43.

In this respect, the apparatus illustrated is under the control of computer or microprocessor 111 as shown in FIG. 15. The computer receives information about the articles and is arranged to cause actuation of the actuators to effect sorting of the articles.

However, it will be appreciated that as the articles are conveyed they can change location and position. This is especially true as they need to be rotated to ensure all round inspection for the determination of any defects. Means therefore need to be provided to track each article as it moves through the apparatus, and to assign the appropriate information to each article.

Although the vertical averaging and filtering techniques give good results in many circumstances, they do not enable the boundaries of two overlapping articles to be individually assigned and noise and other spurious data can be seen as articles. Therefore, the software is arranged, by way of the algorithm of FIG. 17, to decide if the output signal at any roller gap can be accepted.

In this respect, the system is arranged to consider if any of the articles identified by the output trace 92A appear to be too large or too small. If each pulse defined between a leading edge and the following trailing edge of the trace is within predetermined size limits, it is assumed that each such pulse identifies the location and size of a respective article. Thus, the output trace 92A for the first roller gap 80 at station 1 is checked, and as all the pulses are within the size limits, a further trace 92B is generated, which is in fact, identical to the first trace 92A. The scan performed along the roller gap 80 at station 1 in FIG. 16 is also used to determine an overall colour count for each article, as described above, and this is then associated with the appropriate pulses to produce the output trace 92C of station 1.

A data structure array is allocated in software for each of the articles represented by the trace 92C. Space is allocated in that data structure array for information relating not only to the size and location of each article, but also for information relating to the colour, presence or absence of colour defects, weight, and other quality measurements.

The operation described above for the articles in roller gap 80 is repeated for each of the five roller gaps as 80, 81 and 82. As gap 80 passes down the video screen, to occupy the place originally occupied by gap 81, additional data is added to the corresponding data structure. This is illustrated at station 2 in FIG. 16 where the first roller gap 80 is now occupying the place originally occupied by gap 81. It will be seen that the forward movement of the rollers has rotated and moved the articles 31 in the roller gap 80 such that the articles are now being inspected in different positions. The appropriate output trace 192A produced by the vertical averaging and filtering techniques in this situation is illustrated and it will be noted that the second article from the left has produced two small pulses rather than a single pulse. This can happen where the article has a dark spot or a calyx which is identified as a periphery. The trace 192A also shows a glitch, and furthermore it has identified the two overlapping articles on the right as a single extremely large article.

As previously, the trace 192A is considered in accordance with the algorithm given in FIG. 17. It will be seen that the two pulses for the second object are caused to be combined and a combined colour count is also assigned to that combined pulse. The small glitch pulse is ignored whilst the very large pulse produced by the two overlapping articles is split. Initially, this large pulse is split equally into two.

For an article, such as the first article in the row, where there has been no alteration of the pulse in producing the trace 192B, the second colour count information determined is simply assigned thereto. Where, as in the case of the next article, two pulses are combined to produce a single pulse, the individual colour counts which were determined for two pulses are also retained. However, problems can arise when a large pulse is split into two or more individual pulses, and in this case, the colour count determined for the overlapping article is ignored. In addition, the size of the pulses which have been formed by splitting a large pulse are compared for size and number with the information previously stored, and if possible, the relative proportions of the split pulses are adjusted in accordance with that information. Thus, the size of the two pulses of trace 192B formed by splitting is readjusted to be in the proportions given by the corresponding pulses in trace 92C to form the trace 192C. The information of the trace 192C is then fed into the data structure array associated with the row of articles in the roller gap 80 to update the information stored. As illustrated, a further scan of the articles is then made at a roller station 3 and again a trace 292C is produced and is used to appropriately update the associated data structure array.

Preferably, the data structure array associated with each row is updated on each video frame, 25 times per second. However, where the rate of movement of the roller stations is comparable with the update and analysis period the number of scans is reduced to permit the analysis and amendment of the outputs as described above to take place. In this case, between three and fifteen scans are performed for each roller gap.

At the end of the process, the information in the structure arrays is passed to the selection software. As indicated above the accuracy of the system depends on always detecting the correct number of articles in each row. If this is certain, the selection software then needs only to count articles from the edge of the picture to identify and allocate each one. It will be appreciated from FIG. 16 that because the articles move along the roller gap, the location information collected on the earlier scans is redundant and in fact is overwritten, so that only that obtained on the last scan, trace 292C in FIG. 16, is retained and passed to the selector. It is therefore necessary that the last scan is made at a time when the mechanical handling ensures that no further lateral movement is possible. For example, the last scan can conveniently be made when the objects are at point B, that is, have been removed from the roller gaps.

At this final stage, each data structure array contains information as to the last known positions of the row of articles of a respective roller gap, information as to their size, and whatever measures of quality (such as colour) have been taken. The colour counts referred to may be, for example, taken as disclosed in European Patent Specification No. 194148. The quality measures will relate to the several viewing opportunities which have been provided, and can be normalised for size and number of viewing opportunities so that ideally they give the proportion of the surface area of the object which lies in each category. To this information, weight information from the load cells 37 can be added.

It has been found that the scanning procedure illustrated in FIG. 16 gives accurate object counts. However, if required, it would be possible to retain the position information for all scans of a row and to determine an object count independently for each such row. The information from all the row scans could be used to form an integer-rounded average.

FIG. 15 shows a schematic block diagram of hardware elements for implementing a sorting mechanism in accordance with the invention.

A roller table 1 is illuminated by one or more spotlights, whose light is polarised by polarising filter 116*a*. The colour television camera 33 views articles 31 on the roller table 1, through polarising filter 116*b*. The relative angles of filters 116*a* and 116*b* are adjusted to minimise specular reflection from the roller table, and from the articles. More than one light source may be used, in which case the polarising filter on the camera is preferably fixed, and the polarising filters on the individual light sources are adjusted in turn, in order to obtain minimum specular reflection.

The video signals from a conventional camera are output in Red, Green and Blue primary form. Of course, the output from a commercial PAL decoder is suitable if a PAL-only video source has to be used. The R, G and B signals are converted to digital form and are applied as address signals to a memory such that any unique combination of R, G, B values provide an index to a unique location in the memory space. In order to reduce the memory requirement, a linear matrix unit 104 receives the R,G,B signals and is arranged to produce therefrom two encoded outputs X and Y which are weighted sums of R,G,B, and of any black level offset required. The gain-control elements in the weighting networks are multiplying 8-bit digital to analogue converters where the video signals form the reference inputs and the digital input comes from a register under control of the processor 111. The range of control on each gain element is $-1$ to $+127/128$ of its analogue input. Control is by software, and changes can be implemented virtually instantaneously, for example during the field blanking interval.

The encoded X and Y outputs from the matrix 104 are monitored by an X-Y oscilloscope 105 which gives a visual representation of the projection of RGB space that the matrix is generating. The X output is fed to the analogue input of an image store unit 106 and the Y output to image store units 107 and 108 in parallel. It is occasionally necessary to load the three stores with unadulterated RGB images; this can be done by manipulating the matrix under software control so that X and Y first become equal to G and R respectively, and snatching pictures into the stores 106 and 107 simultaneously. During the next field blanking interval, Y is made equal to B and a snatch similarly initiated into store 108.

The stores 106 and 107 are provided with digital outputs Xd and Yd respectively, which can be switched between data directly from the A/D converter and the image store itself. The switching function is under the control of a video window generator 110. Store 108 has a switch on the input to its picture memory which selects between data from the A/D converter and a digital input from a colour lookup table 109. This is controlled by a status register bit in the store 108.

The colour lookup table 109 consists of 4 blocks of 4096 byte random access memory (RAM), only one block of which is in use at any time. Block selection is controlled by two status bits. In operation, the RAM is worked in read-only mode, and its inputs are divided equally between Xd and Yd from stores 106 and 107. During initialisation, processor 111 has control of all address lines of the colour lookup table and can load information into the memory.

In the embodiment illustrated, the processor 111 is a commercial 68008 based unit running the OS9 operating system. Its modules are designed to run on the G64 bus standard. The configuration consists of a processor card, dual microfloppy disk unit, serial input/output unit and 0.5 megabyte of RAM. The kernel of the operating system is held in ROM. Additional G64 modules have been added which interface with the quality classifier. One such module decodes 265 bytes of address space and extends an auxiliary read/write bus 117 to the various hardware elements of the system. It also contains the master video timing generator 118 which operates at 625 lines 50 field/sec. and also produces the 10.25 MHz clock used in the digital video circuits. Two modules containing 6522 versatile interface adaptors (VIAs) carry out communication tasks with the mechanical elements, responding to interrupts from the shaft encoder on the roller table 1 and passing selection information to processor 111 which operates selection mechanism 114. User interaction is by means of a VDU 112.

The setting-up procedure principally involves defining the parameters of the colour detection system: the matrix and the lookup tables. One possible training procedure to enable the system to identify two different colours is as follows.

1. With the camera viewing a scene containing both target colours, capture Green, Red and Blue images in stores 106, 107 and 108.

2. Without obscuring the target colours, overlay on the stores images four "linear ramp" test patterns, consisting of separate ramps in Green (R and B zero), Red (G and B zero), Blue (G and R zero) and RGB (superimposed on a greyscale). Switch matrix 104 input to store output.

3. With the X and Y outputs of the matrix connected to the XY oscilloscope 105, adjust the matrix gains so that the bright areas corresponding to the two target colours are clearly separated. The test ramps identify the positions of the primaries and the grey line in the resulting projection of RGB space, and are a useful visual frame of reference. Software is available to manipulate the matrix so that the projection can be made to rotate about the three colour axes under control of keystrokes from user terminal 112.

4. Switch matrix inputs to live video from the camera and capture X and Y images in stores 106 and 107.

5. Examine separately the regions corresponding to the two target colours; construct two-dimensional histograms of the X and Y values present in each region, and by thresholding and/or binary expansion and contraction define regions in one 4K block of lookup table 109 which correspond to the target colours. While the lookup table is being defined, the lookup table inputs Xd and Yd are connected to digitised X and Y from the matrix via stores 106 and 107. To assist in visualising the patterns, it is helpful to place in stores 106 and 107 co-incident test images consisting of 128 lines by 128 elements of a horizontal linear ramp in store 107. Window generator 110 gates these test patterns into the Xd and Yd feeds at the appropriate times in each field scan. When manipulation of the lookup table is complete, the system is ready to perform colour detection and object tracking.

The signal corresponding to one of the projected colour axes (usually X) may be the signal subjected to vertical averaging and filtering in the tracking process. It is therefore desirable that this component be of high amplitude compared with the background, and that it be of similar amplitude for each of the target colours. This is easily achieved during stage 3 above by adjusting the projection so that the X components are positive and roughly equal, with differences concentrated in Y. If necessary, DC offsets can be included to ensure that X and Y are both always positive for the target colours.

An automatic procedure to work out an optimum projection involves the generation of a rotation matrix, using a method discussed in Foley and Van Dam, "Fundamentals of interactive computer graphics". With up to three distinct target colours, the existence of an optimum projection is guaranteed; this is one where a line to the observer, or a notional Z axis, is normal to the plane which contains the three colours. In the more usual case of two target colours, C1 and C2, the origin can be included as the third point. A constraint which then assists in the derivation of a component to drive the tracker is to arrange for the projection of the vector joining C1 and C2 to be parallel to the Y axis, which ensures equality of X component for C1 and C2.

Examination of the picture takes place at periodic intervals governed by the velocity of the roller table and the video field drive rate. Strips of the picture which include several scan lines and which cover roller-gaps are processed as discussed above to extract position, size and classification information. The information is stored in arrays of data structures, and one array is associated with each roller gap as it passes down the picture.

When the articles pass out through the field of view, they are immobilised, and the contents of the data structure are used to decide on the subsequent routing of the articles.

It will of course be understood that the above representation is simply one method by which the apparatus in accordance with the invention may be implemented, and a wide range of other possible implementations are possible, within the scope of the invention.

We claim:

1. Apparatus for sorting articles comprising a conveyor arranged to convey the articles through an inspection region, inspection means for scanning the articles in the inspection region and for determining the presence of the boundaries of said articles, means for determining specified parameters for each article, and means for routing articles differently in accordance with the parameters determined, wherein said inspection means is arranged to scan the articles at at least a first station and a second station in the inspection region, said apparatus further comprising means for determining from each of said scans information related to the number and the position of the articles at the respective station, means for associating the parameters determined for each article with the appropriate number and position information, means for storing the number and position information determined from the scan at the first station together with the associated parameters, and means for assessing, from the said stored information and from corresponding information related to the number and position of the articles at the second station and the associated parameters, the actual number of articles, their location at the second station and their associated parameters.

2. Apparatus according to claim 1, wherein said means for determining specified parameters for each article comprises load cells for determining the weight of each article.

3. Apparatus according to claim 1, wherein said means for determining specified parameters for each article comprises means for determining from each of said scans measures of quality of the articles.

4. Apparatus according to claim 3, wherein the measures of quality determined are colour counts for each article.

5. Apparatus according to claim 3, wherein the parameters determined for the articles from the scan at the first station, together with the parameters determined for the articles from the scan at the second station, are associated with the number and position information for the articles at the second station.

6. Apparatus according to claim 1 or 3, wherein said assessing means comprises means for comparing the said stored information with corresponding information related to the number and position of articles at the second station and forming an integer-rounded average to represent the number of articles.

7. Apparatus according to claim 1, wherein said assessing means comprises means for producing an analogue representation of the number and position of the articles at each of said stations, and means for comparing a dimension of the representation of each article with predetermined minimum and maximum values and adjusting any representations which do not fall within said predetermined values.

8. Apparatus according to claim 7, wherein said inspection means is arranged to scan the articles at each station along two bands, and wherein said assessing means comprises means for providing a digital average value or sum of the signal values at corresponding points on all of the scan lines of the two bands, means for producing two differently filtered traces from said digital values, and means for combining said two filtered traces to produce said analogue representations of the number and location of the articles.

9. Apparatus according to claim 8, wherein said digital values are filtered once in the order in which they are obtained and then are filtered in the reverse order to produce said two differently filtered traces.

10. Apparatus according to claim 9, wherein said inspection means is arranged, at each said station, to scan a row of articles along the gap between adjacent rollers in two bands disposed on either side of the centre line of the roller gap.

11. Apparatus according to claim 1, wherein said inspection means is arranged, at each said station, to scan a row of articles along the gap between adjacent rollers in two bands disposed on either side of the centre line of the roller gap.

12. Apparatus according to claim 1, wherein said inspection means is arranged to scan a row of articles along two bands extending along the row, each said band including at least one scan line, and the two bands being spaced on either side of a centre line along the row, and further comprising means for combining the signal values at corresponding points on all of the scan lines of the bands and for providing an average value or sum, and wherein means are provided for conveying said articles to a sorting zone provided with at least one group of actuators for causing or permitting respective ones of the articles to be deposited in accordance with criteria established by said inspection means.

13. Apparatus for sorting articles, comprising a conveyor comprising a plurality of rotable rollers for supporting the articles, and for causing the articles to pass through an inspection zone, means for rotating the rollers, and thereby rotating the articles, in the inspection zone, inspection means for scanning the articles at at least a first station and a second station in the inspection zone, means for determining from each of the said scans the presence and location of surface features of a desired kind on the articles, and the presence of the boundaries of the said articles on the conveyor, and for determining thereby the number of the said articles, and the position of each article along the respective roller pair, means for storing values associated with the position of the articles at the first station, means for comparing the said stored values with corresponding values associated with the position of the articles at the second station, and for determining thereby the position along the rollers at the first station of articles detected at the second station, means for allocating to each article detected at the second station the said surface features detected at the first station, and means for routing articles differently in accordance with the occurrence of the said surface features.

* * * * *